US006422905B2

(12) United States Patent
Samuelsson

(10) Patent No.: US 6,422,905 B2
(45) Date of Patent: Jul. 23, 2002

(54) MARINE PROPELLER, PROPELLER SYSTEM AND COMPONENTS BELONGING THERETO, AND A METHOD OF CONNECTING A PROPELLER

(76) Inventor: Anders Samuelsson, Tullnäsvägen 90, S-945 91 Norrfjärden (SE)

( * ) Notice: Subject to any disclaimer, the term of this patent is extended or adjusted under 35 U.S.C. 154(b) by 0 days.

(21) Appl. No.: 09/486,498

(22) PCT Filed: Sep. 24, 1998

(86) PCT No.: PCT/SE98/01720

§ 371 (c)(1),
(2), (4) Date: Feb. 29, 2000

(87) PCT Pub. No.: WO99/15400

PCT Pub. Date: Apr. 1, 1999

(30) Foreign Application Priority Data

Sep. 25, 1997 (SE) ..... 9703467

(51) Int. Cl.[7] ..... B63H 1/14
(52) U.S. Cl. ..... 440/49; 416/245 A

(58) Field of Search ..... 416/244 B, 245 A; 440/49, 50, 51, 73, 89, 83

(56) References Cited

U.S. PATENT DOCUMENTS

| | | | | |
|---|---|---|---|---|
| 4,507,091 A | * | 3/1985 | Govan | 416/146 R |
| 4,566,855 A | * | 1/1986 | Costabile et al. | 416/134 R |
| 4,842,483 A | | 6/1989 | Geary | |
| 5,547,408 A | | 8/1996 | Skyman | |

FOREIGN PATENT DOCUMENTS

WO WO96/05101 2/1996

* cited by examiner

*Primary Examiner*—Stephen Avila
(74) *Attorney, Agent, or Firm*—Burns, Doane, Swecker & Mathis, LLP

(57) ABSTRACT

In an adapter for adapting a marine propeller to a housing part of a drive source, the adapter includes a hub-connecting side and a housing-connecting side and a portion for fastening the adapter to a propeller hub.

2 Claims, 2 Drawing Sheets

MARINE PROPELLER, PROPELLER SYSTEM AND COMPONENTS BELONGING THERETO, AND A METHOD OF CONNECTING A PROPELLER

This application is a national stage filing under 35 U.S.C. § 371 of International Application No. PCT/SE98/01720 filed on Sep. 24, 1998, which International Bureau in English on Apr. 1, 1999.

FIELD OF INVENTION

The present invention relates to a marine propeller, a propeller system, an adapter, a set of adapters, and a method of connecting a propeller.

BACKGROUND OF THE INVENTION

Marine propellers are normally driven by a motor, or an engine, to which the propeller is connected through the medium of an output shaft from a gearbox coupled to the motor. Such motors are manufactured and supplied by a large number of manufacturers, wherewith each manufacturer gives the motor and associated gear housing his/her particular design. This normally results in that a certain propeller will only fit the motor of a particular manufacturer. The decisive factor as to whether or not the propeller can be connected to a given motor is whether or not the output shaft from the motor gearbox can be coupled to the propeller hub, which is normally effected with the aid of a spline coupling. Another deciding factor is whether or not the propeller hub is configured so as to enable it to be fitted in the gearbox opening through which the drive shaft extends. The first aspect will not normally constitute a problem, since the propeller hub is standard for a given power class and the splines identical. On the other hand, the connecting flange on the gearbox may have a different configuration and the output shaft a different length. This is the primary cause of the problem that resides in the propeller hub not being adapted to the connecting flange of the gearbox and/or that the shaft extends too far or not far enough at the point where the hub shall be connected to the gearbox.

It is known from WO 96/05101 and U.S. Pat. No. 4,842,483, for instance, to provide an adapter between the hub splines and the shaft splines in respect of small-craft motors that have different spline dimensions because of different drive powers, for instance, so as to enable one and the same propeller to be connected to drive shafts of mutually different spline dimensions by appropriate adapter selection. However, the solution does not solve the problem of adapting the hub to suit the flange of the gearbox and to the length of the drive shaft.

Seen against this background, the object of the present invention is to enable one and the same propeller to be used with different types of motors with regard to connecting such motors to the propeller, particularly the design of the gearbox connecting flange, and with regard to the length of shaft extending from the gearbox.

SUMMARY OF THE INVENTION

The object with respect to the first aspect has been achieved in accordance with the invention by means of a marine propeller, a propeller system, an adapter, and a set of adapters according to the present invention.

Because the propeller is provided with a separate adapter element that is fastened detachably to the hub and has a side adapted to the gearbox flange and the shaft length, one and the same propeller can be connected to any one of several different types of motor by appropriate selection of an adapter element. This obviates the need for a propeller manufacturer or supplier to maintain a large assortment of propellers in order to be able to supply a particular propeller for a particular motor. In principle, it will suffice to have one propeller in each size class and a set of adapter elements that suit different types of motor. This rationalises both manufacture and storage and makes manufacture and storage less expensive.

Because that part of the drive source housing to which the propeller shall be connected is normally comprised of a circular flange positioned about a shaft exit opening in the gearbox, it is suitable to provide the housing-adapting side with an axially directed circular flange. This can then be inserted into the gearbox flange with a small clearance and co-act with said flange to form a sealing casing around the drive shaft. An adapter element of this design thus constitutes a preferred embodiment of the invention.

According to a further preferred embodiment of the invention, the propeller is adjustable so as to enable the propeller blades to be adjusted to other settings in distinct steps and in unison. This widens the field of use in respect of each type of propeller and therewith further contributes towards achieving the object of the invention, to-wit of reducing the number of propellers necessary in one assortment.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF PREFERS EMBODIMENTS OF THE INVENTION

Figure 1:
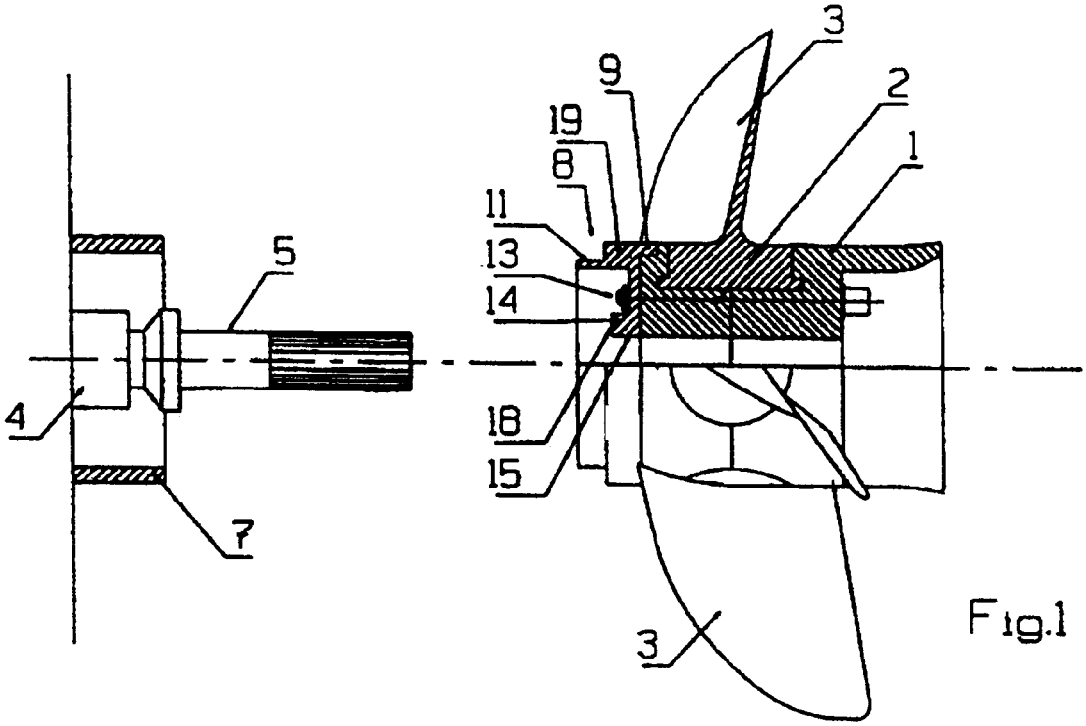
FIG. 1 illustrates partly in section and partly in side view a propeller according to a first embodiment of the invention.

FIG. 1 illustrates an inventive propeller that includes a plurality of propeller blades 3 fastened radially to a hub that consists of a front hub-half 2 and a rear hub-half 1. The rear hub-half 2 is adapted for connection with a gearbox 4 which, in turn, is connected to a drive motor (not shown). The gearbox includes an output shaft 5 that has splines which connect drivingly with corresponding splines inside the hub. An axially facing circular flange 7 is mounted on the shaft 5.

The propeller is connected to the gearbox with the aid of an adapter element 8 in the form of a circular ring that has a rearwardly facing axial flange for connection with the hub, and a forwardly facing axial flange 11 for co-action with the gearbox flange 7. The adapter element 8 has a central part 14 which includes a central opening 15 through which the shaft extends to the hub. After having fitted the propeller to the gearbox, the adapter element is fastened to the front part 2 of the hub by means of bolts 13 or the like, so that the adapter will rotate together with the hub 1, 2 in operation. The flange 11 extending towards the gearbox projects into the flange 7 on said gearbox and rotates in said gearbox with a small amount of play. Naturally, the adapter element may be fastened to the hub in some way other than through the medium of the bolts 13 that hold the hub together.

Figure 2:
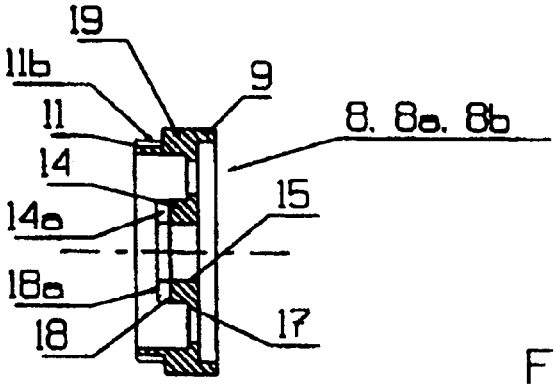
FIG. 2 is a sectional view of an adapter element according to the invention, said element being one of a set of such elements.

FIG. 2 illustrates the adapter element 8 in more detail and shows how a series or set of such elements can be built-up. Shown in that part of the adapter element which connects the outer part 19 and the inner part 14 together, is one of the bolt holes 16 by means of which the adapter element is fastened to the hub, and one of several exhaust passages 17 through. which motor exhaust gases can pass.

The flange 11 on the outer ring 19 facing towards the gearbox can have different outer diameters in respect of different adapter elements, as indicated by the broken line 11*b*. The axial length of the inner part 14 of the adapter element may vary in respect of different elements by virtue of extending through respective different distances towards the gearbox, therewith adapting the abutment surface 18, 18*a* of said central part of the element to the length of the drive shaft in question. The axial extension of the outer ring 19 and/or of the flange 11 may also be varied.

Figure 3:
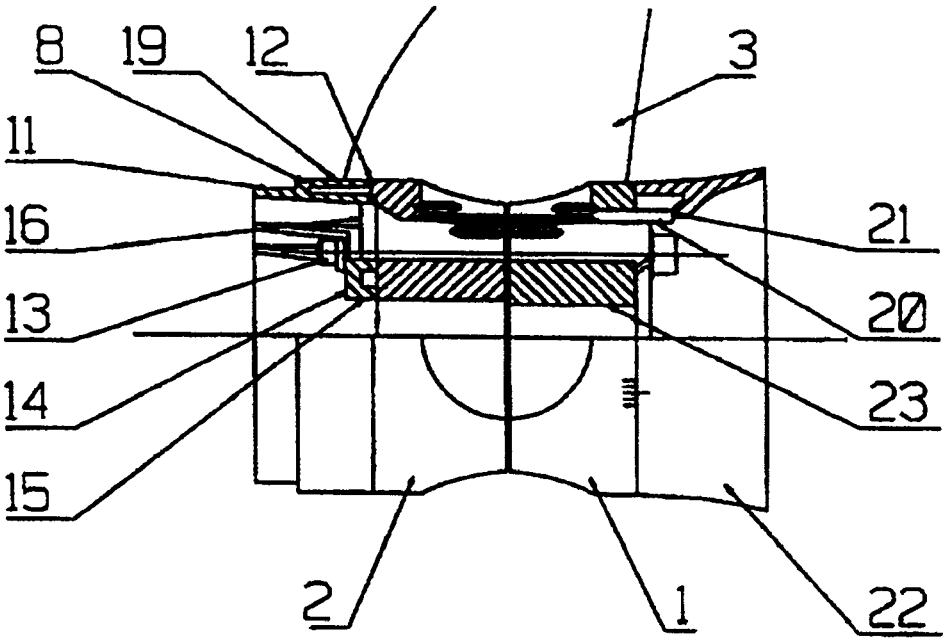
FIG. 3 illustrates partly in side view and partly in section a propeller according to a second embodiment of the invention.

FIG. 3 illustrates another embodiment of the invention as applied to a propeller whose blade settings can be adjusted incrementally and in unison, said propeller being the subject of Patent Application SE 9703466-4 filed on the same day as the present Application. The root-part 24 of each propeller blade 3 is mounted between the hub-parts 1 and 2 for rotation or angular movement about an axis that extends perpendicular to the centre axis of the propeller. Each root-part 24 is provided with a blade setting adjustment arm 20 which extends rearwardly in the axial direction of the propeller and received in a recess 21 in an adjusting ring 22. The ring 22 can be loosened from the hub-part 1 so as to enable the ring to be moved axially away from said hub-part therewith enabling it to be rotated. This rotation is transmitted to the blades 3 via the recesses 21 and the arms 20, so that said blades can be rotated in unison. The ring 22 can be locked to the hub-part 1 in any one of a number of distinct positions that correspond to a plurality of distinct blade setting positions. The construction of this blade setting adjustment arrangement is described in more detail in the Swedish Patent Application referred to above.

The adapter element 8 is secured to the front hub-half 2 at the forward end of the hub by means of bolts 13. The adapter element 8 comprises an annular outer part 19, an annular inner part 14 and connecting parts that connect the outer part to the inner part. The inner part has a central opening 15 for transit of the drive motor shaft. When the propeller is fitted to the propeller shaft, the shaft extends through the opening 15 and through the hub-half 2 and into the hub-half 1 and there engages splines (not shown) on the inner surface 23 of the hub-part 1.

A circular flange 11 extends forwardly and axially from the outer annular part 19 towards the gearbox and lies against a flange of corresponding dimensions on said gearbox. The diameter of the flange 11 is thus chosen to fit against the flange on the gearbox, and the axial length of the inner part 14 is chosen so that the drive shaft will extend sufficiently for its splines to be located opposite the splines provided on the inner surface of the hub-part 1. A flange 11 of correct diameter and a part 14 of the correct length are obtained by choosing the appropriate adapter element 8 from a series or set of such elements as illustrated in FIG. 2, wherein each element is constructed to suit the output shaft of known existing types of motor.

The adapter element also includes a number of axially penetrating openings 16 located between the outer and the inner rings. These openings are intended to enable motor exhaust gases to pass axially through the hub.

What is claimed is:

1. A propeller system comprising:

a marine propeller that includes a hub having drive connection means for drive connection to an output shaft of a drive source, and propeller blades attached to said hub, and a series of adapters;

wherein each adapter has a first side, detachably fastened to the hub and a second side arranged to cooperate with a flange on a housing side of said drive source, each adapter differing from each other by adapting uniquely to various housings of said drive source, wherein each adapter in the series of adapters includes an outer part having a circular flange extending in an axial direction from the second side, and each adapter in the series of adapters further includes an inner part which is connected to the outer part and which includes a shaft transit hole coaxial with the circular flange, wherein the inner part has an abutment surface on the second side, and wherein each adapter in the series of adapters differs from each other adapter in the series of adapter with respect to at least one of a size of an outer diameter of the circular flange and an axial extension of the inner part.

2. A set of adapters for adapting a marine propeller to a housing part of a drive source, each adapter in the set of adapters having a first side, detachably fastened to the hub and a second side arranged to cooperate with a flange on a housing side of said drive source, each adapter differing from each other by adapting uniquely to various housings of said drive source, wherein each adapter includes an outer part having a circular flange extending in an axial direction from the second side, and further includes an inner part connected to the outer part and having a shaft transit hole coaxial with the circular flange, wherein the inner part has an abutment surface on the second side, and wherein each adapter element differs from the remaining elements in said series with regard to the outer diameter of the circular flange and/or the axial extension of said inner part.

* * * * *